US006139312A

United States Patent [19]

Lasagni

[11] Patent Number: 6,139,312

[45] Date of Patent: Oct. 31, 2000

[54] CYLINDRICAL GAS BURNER

[75] Inventor: Feliciano Lasagni, Vignola, Italy

[73] Assignee: Worgas Bruciatori S.r.l., Modena, Italy

[21] Appl. No.: 09/334,850

[22] Filed: Jun. 17, 1999

[51] Int. Cl.[7] ..... F23D 14/62

[52] U.S. Cl. ..... 431/354; 431/328; 431/12; 431/75; 431/63; 126/92 AC

[58] Field of Search ..... 431/353, 354, 431/350, 23, 75, 8, 12, 326, 328, 329, 62, 63; 126/92 AC, 92 R, 91 R

[56] References Cited

U.S. PATENT DOCUMENTS

| | | | |
|---|---|---|---|
| 4,545,430 | 10/1985 | Retallick | 431/353 |
| 4,599,066 | 7/1986 | Granberg | 431/329 |
| 4,614,493 | 9/1986 | Nakamura et al. | 126/92 AC |
| 5,165,887 | 11/1992 | Ahmady | 431/326 |
| 5,762,489 | 6/1998 | Wunning | 431/353 |

FOREIGN PATENT DOCUMENTS

| | | |
|---|---|---|
| 239189 | 9/1987 | European Pat. Off. . |
| 0 844 436 A1 | 5/1998 | European Pat. Off. . |
| 92 01 313 | 3/1992 | Germany . |
| 91 02 991 | 7/1992 | Germany . |
| 295 10 374 | 9/1995 | Germany . |
| 195 33 906 | 3/1997 | Germany . |
| WO94/16269 | 7/1994 | WIPO . |

*Primary Examiner*—Ira S. Lazarus
*Assistant Examiner*—Josiah C. Cocks
*Attorney, Agent, or Firm*—Fay, Sharpe, Fagan, Minnich & McKee, LLP

[57] ABSTRACT

A gas burner comprises an elongated tubular body with a sidewall which has outer end edges between which there are apertures which pass through the sidewall; a flange with a central through hole and an opposite base cap, the sidewall, flange and base cap being attached to one another in such a way that together they define a first mixing chamber, in which a flow of gas and air, received through the flange, exits the tubular body through the apertures in the sidewall; the flange and base cap having opposite guides; the sidewall being wound in a spiral and having juxtaposed longitudinal edges with fluid tight seals and outer end edges inserted in the guides with a play designed to allow the perimeter of the sidewall to expand or contract according to changes in the temperature of the body.

15 Claims, 3 Drawing Sheets

1
2
2a
3
4
5
6
8
9
10
13
14
15
19
20
II

CYLINDRICAL GAS BURNER

BACKGROUND OF THE INVENTION

The present invention relates to a gas burner. It is known that gas burners are devices in which a flow of combustible gas is introduced into a mixing chamber, where it is mixed with a flow of comburent (usually air) supplied in a suitable proportion to the combustible gas. After mixing, the mixture of combustible gas and comburent exits the mixing chamber through a sidewall of said chamber with holes in and is burnt.

The gas is burnt a short distance from the sidewall, which is intensely heated. This heating is localized and its intensity is reduced as the distance between the points of the sidewall and the flame increases.

As a result, the material of which the burner is made is subject to extensive, variable thermal expansion.

When this expansion is prevented, the material of which the burner parts are made is subject to dangerous increases in stress and deformation which, in the most serious cases, may cause parts to give or break. Operating conditions with less intense stress are no less dangerous, since any expansion prevented modifies the geometry of the gas mixture outlet holes, creating the risk of the flame flashing back into the burner.

The present invention relates to a burner of the type comprising: an elongated tubular body with a sidewall between whose outer end edges there are apertures passing right through the sidewall; a flange with central through-hole; a base cap opposite the flange, a truncated cone shaped sector inside the sidewall, open at the end with the smaller diameter, fixed to the sidewall at a point on the end with the larger diameter, and free of other constraints. The sidewall, flange, base cap and truncated cone sector are attached to one another in such a way that together they form a chamber in which a flow of air and gas mixture, received through the hole in the flange, gradually exits the tubular body through the apertures in the sidewall, where the taper of the truncated cone sector reduces the internal passage section gradually as the volume of the internal gaseous mass is reduced because part of said mass exits through the apertures in the sidewall.

SUMMARY OF THE INVENTION

The aim of the present invention is to overcome the above-mentioned disadvantages by providing a burner with a flame distributed along the circumference and which allows free expansion of the circumference, maintaining the volume and speed of the mixture which exits the apertures at the most suitable values for optimum combustion, in terms of both the efficiency of the combustion and uniform distribution of the flame along the burner.

In accordance with the present invention, this aim is achieved with a gas burner, of the type indicated in the preamble to claim 1, in which the flange and base cap have guides positioned opposite one another and in which the sidewall with apertures is wound in a spiral, with fluid tight juxtaposed longitudinal edges and outer end edges inserted in the flange and cap guides; the outer end edges are mounted in the guides with a play which allows free expansion and contraction of the perimeter of the burner sidewall according to changes in the temperature of the tubular body. The burner also has adjusting means, designed to automatically adjust the volume of gas entering the tubular body, depending on the thermal expansion or contraction of the sidewall of the tubular body; expansion of the sidewall, free to move as indicated above, is proportional to the average temperature of the sidewall. A position transducer, connected to the sidewall (not part of the solution disclosed, since it can be made according to known techniques), or the force exerted by the sidewall can control a gas/air control part (if present), so as to vary the volume of the mixture in the burner depending on the temperature.

A burner made according to the present invention has many advantages. The sidewall wound in a spiral and completely free of constraints on its free expansion allows the burner to be used even in extreme operating conditions, without the danger of structural collapse or malfunctions, and without any limitations on the term of said operating conditions. Moreover, since the adjusting means comprise an element which intercepts the volume of gas entering the mixing chamber and which is fixed to the sidewall, control of the volume of gas which feeds the flame is automatically correlated to the expansion of the sidewall.

BRIEF DESCRIPTION OF THE DRAWINGS

Further characteristics and advantages of the invention are apparent from the claims herein and from the detailed description which follows, with reference to the accompanying drawings, which illustrate preferred embodiments of the invention without restricting the scope of the inventive concept and in which:

DESCRIPTION OF THE PREFERRED EMBODIMENTS

Figures 1, 1A, 1B:
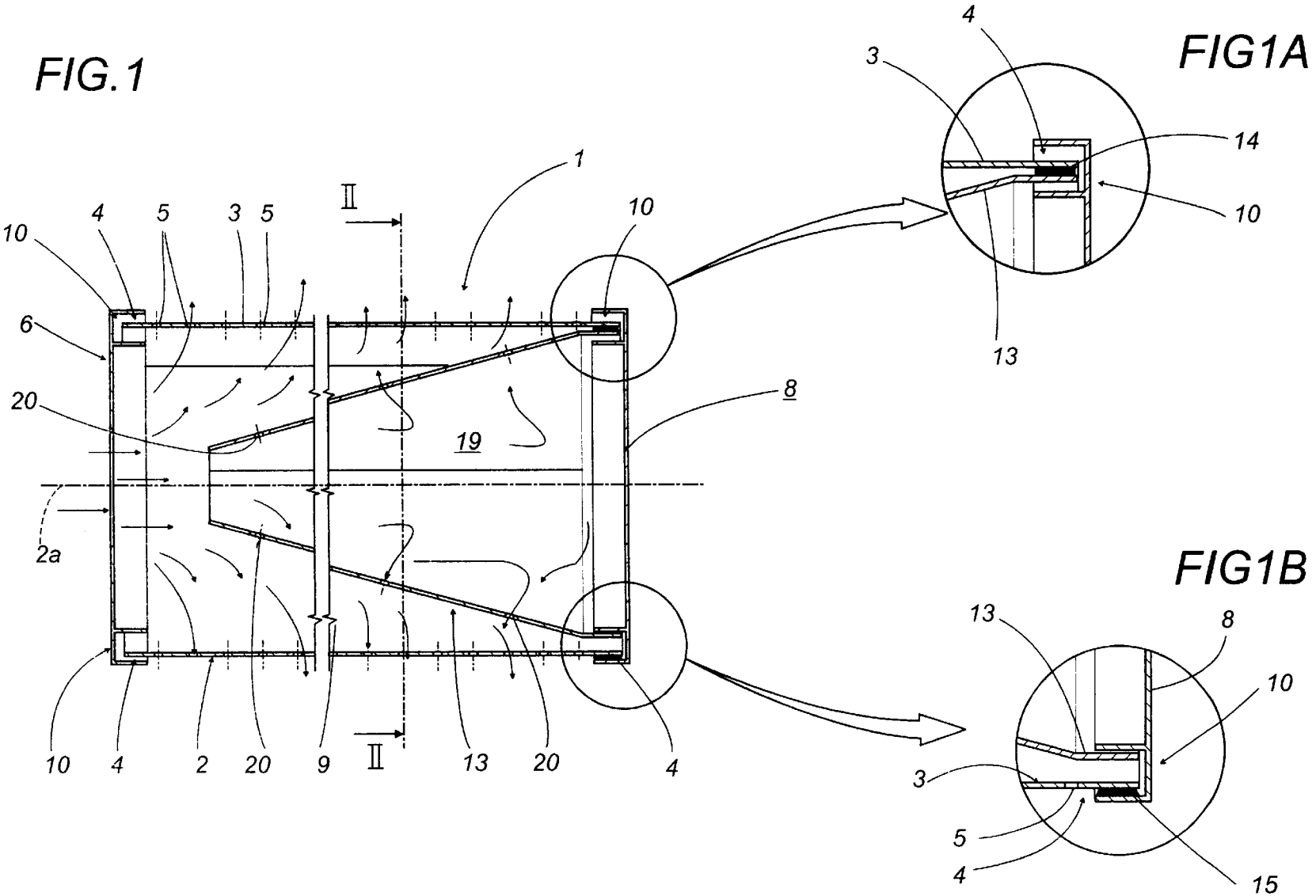
FIG. 1 is an axial section of a burner made according to the present invention, illustrated as a whole.
FIGS. 1A and 1B are scaled up detailed views illustrating several details of the burner.

With reference to the drawings listed above, the numeral 1 indicates a gas burner as a whole (see FIG. 1), comprising a cylindrical elongated tubular body 2, having a sidewall 3, a flange 6 and base cap 8 all made of metal, for example alloy steel.

Figure 2:
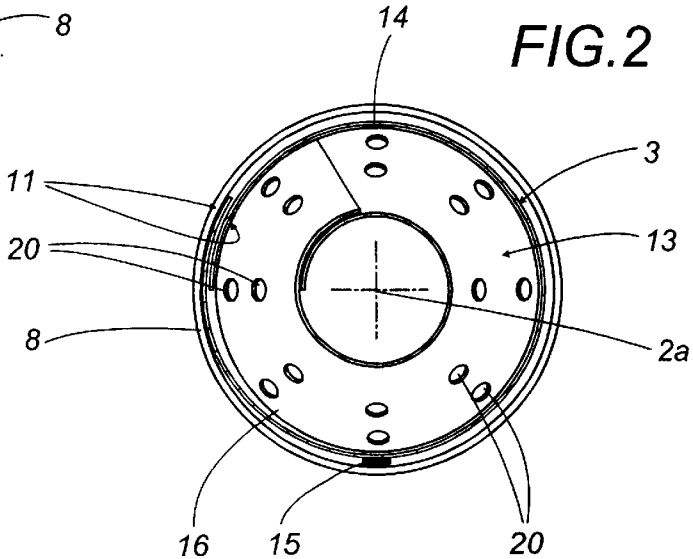
FIG. 2 is a cross-section along line II—II of the burner illustrated in FIG. 1.
Figure 3:
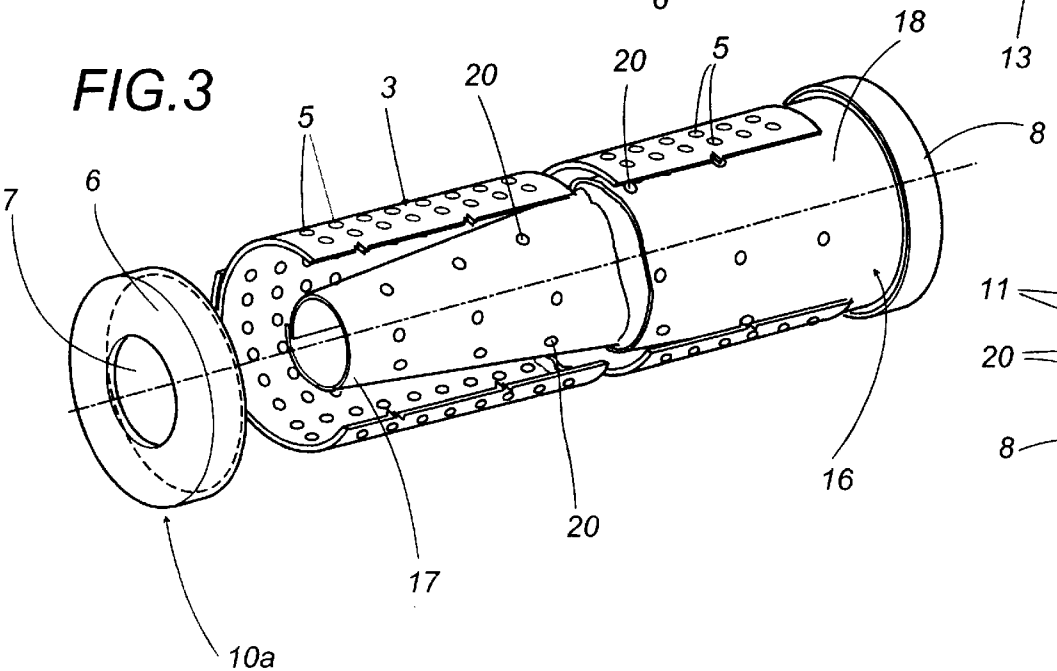
FIG. 3 is an exploded perspective assembly view of the burner illustrated in the previous figures.

The entire thickness and substantially the entire surface of the sidewall 3 made, for example, from a sheet of metal, has apertures 5, in particular circular holes (or other purpose-made apertures), located between the outer end edges 4 of the sidewall 3; the latter is wound about itself and has a spiral cross section (see FIG. 2) with juxtaposed longitudinal edges 11, connected to one another with conventional fluid tight seals of the type known as labyrinth seals. These edges may be finished in such a way that it is guaranteed that they slide over one another even when they make contact: for example, the edges may have an end slide, to prevent an edge from catching on the adjacent sheet of metal with sharp edges and/or burs.

The flange 6 has the shape of a flat disk, in particular circular, with a central through hole 7 and an external edge

10*a* which has a continuous, substantially U-shaped guide 10 substantially parallel with the axis 2*a* of the tubular body 2.

The base cap 8 has the shape of a solid flat disk similar to the flange 6 opposite its continuous guide 10.

The flange 6 and base cap 8 are attached to the sidewall 3 with their guides 10 opposite one another so as to house the opposite outer end edges 4 of the sidewall 3 with a given amount of play across the axis 2*a* of the tubular body 2.

At least one of the guides 10 in the flange 6 or base cap 8 attaches to at least one of the outer end edges 4 of the sidewall 3 at a reciprocal connection zone 15 (preferably by means of welding), there being only one for the entire circumference of the sidewall 3 and guide 10. This allows the sidewall 3 (see FIG. 2) to expand or contract freely under the more or less intense effect of the heat of combustion, varying the transverse dimensions of the tubular body 2, at the sidewall 3, allowing the latter to deform freely, although constrained to remain with the external edges 4 inserted in the guides 10.

In the above-mentioned assembly, the flange 6, base cap 8 and sidewall 3 combine to define a first chamber 9 in which a gas/air flow exits the tubular body 2 through the apertures 5 in the tubular sidewall 3, feeding the burner 1 combustion process.

The air can be fed into the first chamber 9 either by the suction effect of a vacuum created in the mixing chamber 9 using conventional means which are not described in detail (so-called atmospheric burners); or by means of a mechanical acceleration created on the air from outside, and if necessary also on the gas, using equally conventional means which are not described, since their technical characteristics are well known to experts in the sector and are not part of the subject matter of the present invention (forced infeed burners, which may have pre-mixing).

Similar considerations may be made regarding the means which ignite the mixture exiting the apertures 5 in the sidewall 3, which are not illustrated in the accompanying drawings since they are not part of the present invention and are well known.

Figure 4:
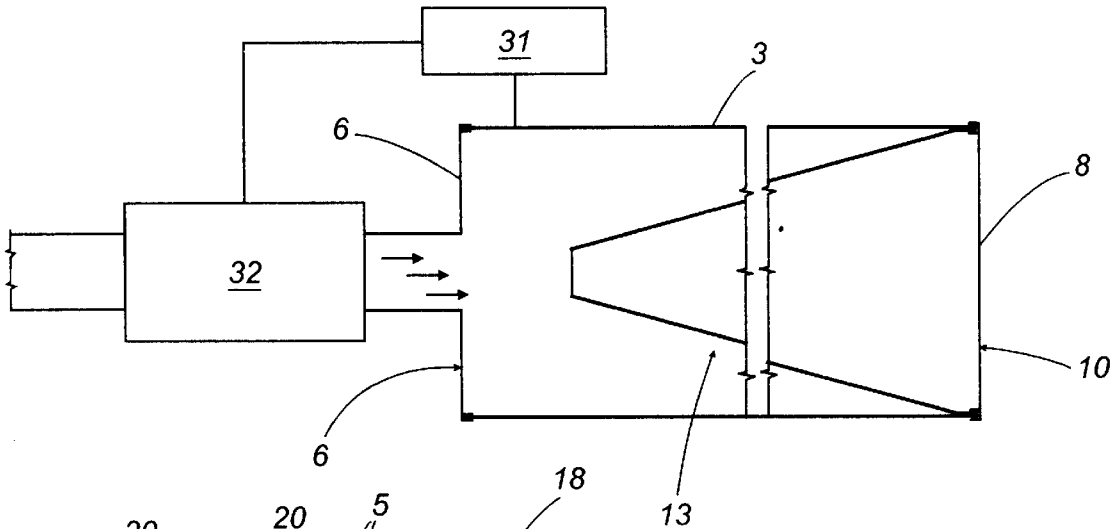
FIG. 4 is a diagram of the burner illustrated in the previous figures, equipped with means for adjusting the air/gas flow according to the present invention.

The burner 1 made according to the present invention also comprises adjusting means, to adjust the volume of gas entering the tubular body 2 through the central hole 7 in the flange 6, depending on the thermal expansion or contraction to which the sidewall 3 is subjected due to the heating action created by the current gas combustion process. These means may comprise a position transducer 31 connected to the sidewall 3, or may be the sidewall itself connected to a special part 32 which controls the infeed of the gas/air (see FIG. 4 in particular).

A further solution for the above-mentioned adjusting means comprises a truncated cone element 13 which intercepts the volume of combustible gas, also tubular in shape and located inside and coaxial with the tubular body 2 of the burner 1, and with a sidewall 16 with overall truncated cone shape.

The sidewall 16 has a tapered first end 17 which is open, contiguous with the hole 7 in the flange 6 and counters the flow of gas, arriving from the outside, which enters the tubular body 2 through the flange 6. A second, opposite end 18 of the sidewall 16 is inserted in the guide 10 in the base cap 8 and is sealed against the passage of gas by the cap 8.

The sidewall 16 of the intercepting element is fixed to the sidewall 3 of the tubular body 2 at a reciprocal connection zone, labeled 14 (again, preferably welded), there being only one, better identified in FIG. 1A.

The sidewall 16 and base cap 8 together delimit a second chamber 19 for the passage of the gas, which is coaxial with and inside the first mixing chamber 9.

The sidewall 16 also preferably has through holes 20 which allow communication between the first and second mixing chambers 9, 19.

Returning to the intercepting element 13, by means of constriction, this adjusts the volume of gas entering the first mixing chamber 9. This type of adjustment allows the volume to be unaffected by changes in the cross-section of the apertures 5 through which the mixture exits the burner 1.

If the sidewall 16 of the intercepting element has holes in it, allowing communication between the first and second mixing chambers 9, 19, adjustment of the number and diameter of the intercommunicating holes 20 allows a further adjustment of the fluid dynamics of the gases inside the burner 1, allowing the volume and speed of the gas flow to be balanced so as to modulate the performance of the burner 1, further enhancing the above-mentioned advantages in terms of combustion efficiency and uniform flame distribution.

Figure 5:
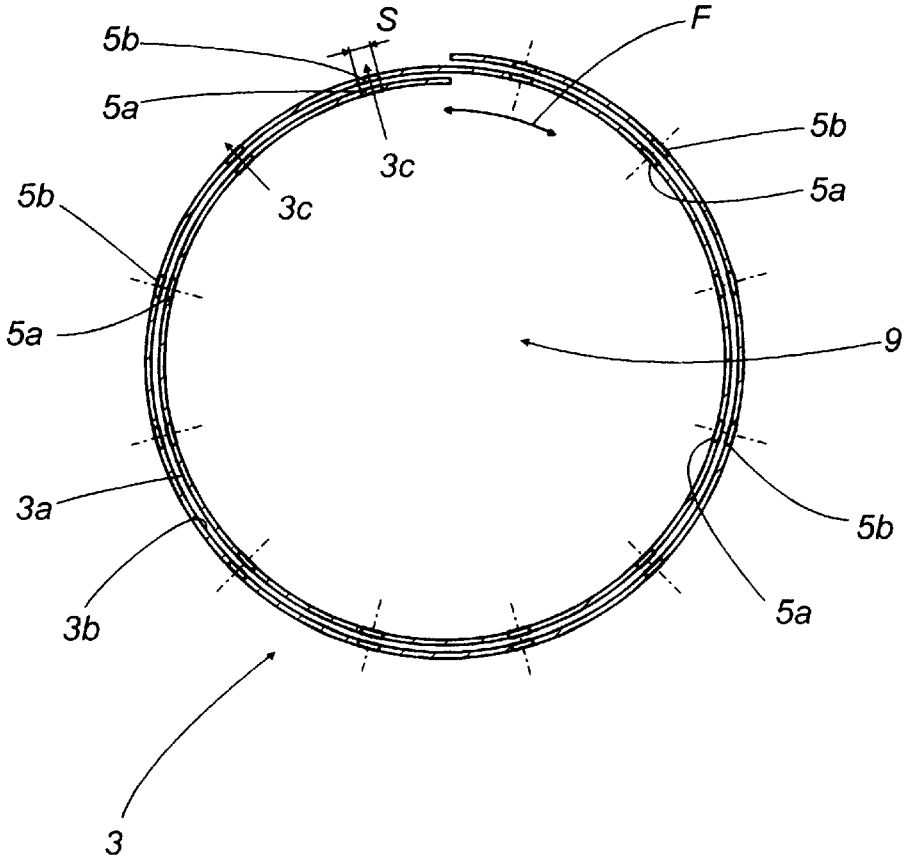
FIG. 5 is a schematic front view of an alternative embodiment of the burner according to the present invention, and in particular a sidewall of the burner.
Figure 6:
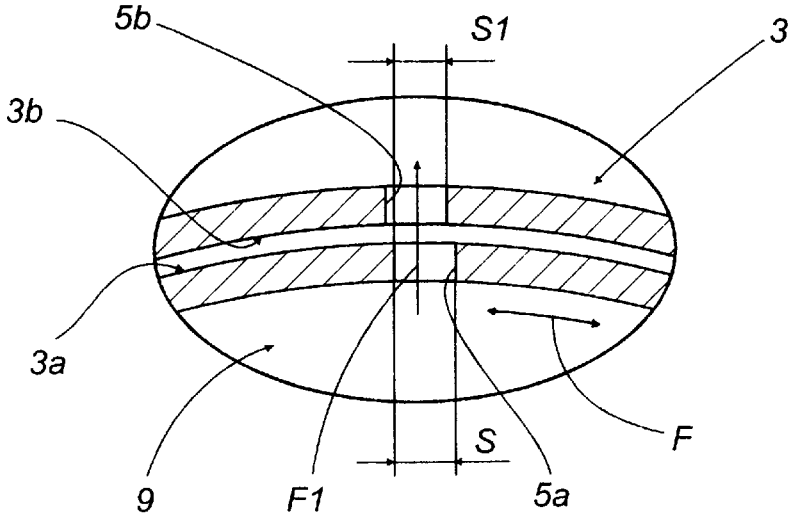
FIG. 6 is a scaled up schematic front view of the burner sidewall illustrated in FIG. 5, with some parts in cross-section.

To confirm the validity of the solution described, FIGS. 5 and 6 illustrate an alternative embodiment of the burner according to the present invention. In this particular solution, the above-mentioned spiral-shaped sidewall 3 is wound around itself for a length approximately equivalent to a double round angle, so as to define two surfaces, labeled 3*a* and 3*b* in FIGS. 5 and 6, overlapping one another.

These two overlapping surfaces 3*a* and 3*b* have a plurality of matching through apertures 5*a* and 5*b*, arranged so that they are substantially radially coincident, that is to say, coaxial, when the burner is in a balanced condition during nominal operation (i.e.: at a reference temperature): in this way a corresponding plurality of through channels 3*c* with cross-section S are defined, for the passage of the air/gas mixture from the first chamber 9 to the outside of the tubular body 2, according to a preset volume.

As described in the previous solution, the pair of longitudinal surfaces 3*a* and 3*b* of the sidewall 3 have outer end edges 11 inserted in the above-mentioned guides 10 in the flange 6 with a given amount of play: this allows expansion and contraction (see arrow F in FIGS. 5 and 6) of the perimeter of the sidewall 3 according to changes in the temperature of the tubular body 2.

In this specific case, the above-mentioned thickness and section S of the sidewall 3 are such that they allow the opposite pairs of apertures 5*a* and 5*b* to be offset when the sidewall expands or contracts, obtaining a change S1 (see FIG. 6) in the passage cross-section S with a relative increase in the speed at which the mixture passes through (see arrow F1 in FIG. 6), under the same conditions of volume, designed to allow the burner balanced condition during nominal operation to be restored: in fact, by increasing the outflow speed of the mixture, the flame moves away from the surface of the burner and the surface cools.

In other words, with this type of structure an automatic adjustment system is obtained (depending on the current temperature), which tends to adjust the temperature of the sidewall gradually as it rises or falls relative to a preset value.

The above description indicates that the present invention completely fulfils the aims indicated, preventing any dangerous increases in stress due to inhibited expansion and so considerably lengthening the operating life of the burner 1, as well as reducing the danger of breakage and malfunctions. The present invention also allows optimized, automatic adjustment conditions which are unchanged relative to the burner 1 operating temperature.

The invention described can be subject to modifications and variations without thereby departing from the scope of the inventive concept. Moreover, all the details of the invention may be substituted by technically equivalent elements.

What is claimed:

1. A gas burner comprising an elongated tubular body with a sidewall, having outer end edges between which there are apertures which pass through the sidewalls; a flange with a central through hole; and a base cap opposite the flange; the sidewall, flange and base cap being attached to one another in such a way that together they define a first chamber in which a flow of gas and air, received through the hole in the flange, exits the tubular body through the apertures in the sidewall, wherein the flange and base cap have guides, these being opposite one another, and wherein the sidewall is wound in a spiral shape and has juxtaposed longitudinal edges, these being fluid tight, and outer end edges inserted in the guides in the flange and cap, said outer end edges being mounted in the guides with a given amount of play, designed to allow expansion and contraction of the perimeter of the sidewall according to changes in the temperature of the tubular body.

2. The burner according to claim 1, comprising adjusting means for adjusting the distribution and volume of the gas entering the tubular body, depending on the thermal expansion or contraction of the sidewall of the tubular body.

3. The burner according to claim 2, wherein said adjusting means comprise a unit which detects the position of the sidewall, this being connected to a part which controls the passage of gas/air, being designed to vary the flow of gas/air depending on the expansion or contraction of the sidewall.

4. The burner according to claim 2, wherein the adjusting means comprise at least one truncated cone-shaped intercepting element, this being attached to the sidewall of the tubular body and attached to the hole in the flange in such a way as to vary the distribution of a gaseous fluid which enters the tubular body.

5. The burner according to claim 4, wherein the intercepting element and the sidewall of the tubular body are fixed to one another at a single connection zone.

6. The burner according to claim 1, wherein at least one of the outer end edges is fixed to at least one of the guides at a single connection zone.

7. The burner according to claim 4, wherein the intercepting element is located inside and coaxial with the tubular body and has a sidewall, said sidewall having a first tapered end, contiguous with the hole in the flange and countering the flow of gas entering the tubular body.

8. The burner according to claim 7, wherein the intercepting element has a sidewall with an open, tapered end, and a second, opposite, closed end, the sidewall and the ends together delimiting a second chamber for the passage of air/gas inside the first chamber.

9. The burner according to claim 8, wherein the sidewall of the intercepting element has at least one aperture or hole for communication between the first and second chambers for the passage of air/gas.

10. The burner according to claim 7, wherein the sidewall of the intercepting element is fixed to the sidewall of the tubular body at a single reciprocal connection zone.

11. The burner according to claim 1, wherein the tubular body is cylindrical in shape.

12. The burner according to claim 1, wherein the spiral sidewall is wound about itself for a length approximately equivalent to a double round angle, defining two overlapping surfaces.

13. The burner according to claim 1, wherein the spiral sidewall is wound about itself for a length approximately equivalent to a double round angle, defining two overlapping surfaces; the two overlapping surfaces having a plurality of matching through apertures, these being radially coincident, that is to say, coaxial, when the burner is in a balanced condition during nominal operation, and defining a plurality of channels, with a section through which air and gas mixture flow from the first chamber to the outside of the tubular body with a preset volume.

14. The burner according to claim 1, wherein the pair of longitudinal overlapping surfaces of the sidewall have their outer end edges inserted in the guides in the flange with a play designed to allow expansion and contraction of the perimeter of the sidewall according to changes in the temperature of the tubular body; the thickness of the sidewall and the section being such that they allow the opposite pairs of apertures to be offset, obtaining a change in the passage section with a relative increase in the speed at which the mixture passes through, under equal conditions of volume, so as to allow the burner balanced condition during nominal operation to be restored.

15. The burner according to claim 13, wherein the pair of longitudinal overlapping surfaces of the sidewall have their outer end edges inserted in the guides in the flange with a play designed to allow expansion and contraction of the perimeter of the sidewall according to changes in the temperature of the tubular body; the thickness of the sidewall and the section being such that they allow the opposite pairs of apertures to be offset, obtaining a change in the passage section with a relative increase in the speed at which the mixture passes through, under equal conditions of volume, so as to allow the burner balanced condition during nominal operation to be restored.

* * * * *